US008047813B2

(12) United States Patent
Sevy

(10) Patent No.: US 8,047,813 B2
(45) Date of Patent: Nov. 1, 2011

(54) NOISE-SUPPRESSION PUMP APPARATUS AND METHOD

(76) Inventor: Earl Vaughn Sevy, Enoch, UT (US)

( * ) Notice: Subject to any disclaimer, the term of this patent is extended or adjusted under 35 U.S.C. 154(b) by 447 days.

(21) Appl. No.: 12/247,795

(22) Filed: Oct. 8, 2008

(65) Prior Publication Data

US 2010/0086418 A1 Apr. 8, 2010

(51) Int. Cl.
*F04B 17/04* (2006.01)
*F04B 39/06* (2006.01)
*H02K 33/00* (2006.01)

(52) U.S. Cl. ..... 417/363; 417/371; 310/15

(58) Field of Classification Search ..... 417/413.1, 417/363, 366, 371; 181/232, 207; 310/15, 310/29, 43, 51
See application file for complete search history.

(56) References Cited

U.S. PATENT DOCUMENTS

| | | | | |
|---|---|---|---|---|
| 3,641,757 | A * | 2/1972 | Rehn | 57/1 R |
| 5,137,432 | A * | 8/1992 | Tsai | 417/312 |
| 6,168,392 | B1 * | 1/2001 | Takano | 417/312 |
| 6,217,281 | B1 * | 4/2001 | Jeng et al. | 415/119 |
| 6,364,637 | B1 * | 4/2002 | Hase et al. | 417/413.1 |
| D491,258 | S | 6/2004 | Sevy | |
| D492,020 | S | 6/2004 | Sevy | |
| D509,893 | S | 9/2005 | Sevy | |
| D520,129 | S | 5/2006 | Sevy | |
| D526,710 | S | 8/2006 | Sevy | |
| 7,407,118 | B2 | 8/2008 | Sevy | |

OTHER PUBLICATIONS

Tetra Whisper Aquarium Air Pump 300, Aquarium Guys, Oct. 8, 2008 p. 1, http://www.aquariumguys.com/tetraairpump4.html.
Optima Air Pump A807, Aquarium Guys, Oct. 8, 2008, p. 1, http://www.aquariumguys.com/optimaairpump.html.
Silent Air X-4 Air Pump, Aquarium Guys, Oct. 8, 2008, p. 1, http://www.aquariumguys.com/silentairpump4.html.
Whisper 60 Aquarium Air Pump, Aquarium Guys, Oct. 8, 2008, p. 1, http://www.aquariumguys.com/tetra-whisper60-air-pump.html.
Rena Air 400 Air Pump 702E, Aquarium Guys, Oct. 8, 2008, p. 1, http://www.aquariumguys.com/renaairpump4.html.
Tom Stellar Air Pumps S-30, Fish Tanks Direct, Oct. 8, 2008, p. 1, http://www.fishtanksdirect.com/index.asp?PageAction=VIEWPROD&ProdID=2102.
Pondmaster AP-60 Air Pump, Fish Tanks Direct, Oct. 8, 2008, p. 1, http://www.fishtankdirect.com/index.asp?PageAction=VIEWPROD&ProdID=2107.
Dolpin Air Pump Three Star, Fish Tanks Direct, Oct. 8, 2008, p. 1, http://www.fishtanksdirect.com/index.asp?PageAction=VIEWPROD&ProdID=191.
Tom Stellar Air Pump W-60, Fish Tanks Direct, Oct. 8, 2008, p. 1, http://www.fishtanksdirect.com/index.asp?PageAction=VIEWPROD&ProdID=2104.

* cited by examiner

*Primary Examiner* — Devon C Kramer
*Assistant Examiner* — Bryan Lettman
(74) *Attorney, Agent, or Firm* — John Pate; Pate Baird, PLLC

(57) ABSTRACT

An aromatherapy air pump is damped and largely isolated against acoustic and mechanical transmission of vibrations in three dimensions by a combination of containment within multiple, nested housings and standoffs provided by elastomeric supports having anisotropic geometry. An elastomeric liner as well as unstable legs, physical separations, and hermetic seals combine to provide sound reduction for noise and vibration emanating from the pump and its drive motor.

19 Claims, 6 Drawing Sheets

NOISE-SUPPRESSION PUMP APPARATUS AND METHOD

BACKGROUND

1. The Field of the Invention

This invention relates to air pumps and, more particularly to novel systems and methods for reducing sound and vibration from air pumps used in aroma therapy.

2. The Background Art

Various mechanisms for treating an environment with moisture, medicaments, and the like have been developed using boilers, heaters, fans, and so forth. Aroma therapy involves evaporation, distribution, or other entrainment of volatiles, essential oils, or the like into breathing air, an atmosphere of a room, or other enclosed space. Applicant has previously developed various mechanisms for distributing atomized liquids into the atmosphere. Likewise, various systems for heating or dissolving aromatic or oil-based materials in a solvent to promote evaporation into the atmosphere have also been relied upon in the art. Meanwhile, various medical devices provide humidification of a space such as a "steam tent" or the like.

However, in aroma therapy, it would be an advance in the art to accommodate space, aesthetics, weight, stability, simplicity of use, ease of use, storage, and the like. Accordingly, it would be an advance in the art to provide an integrated system having suitable weight for stability, a sufficiently small size so excessive footprint and volume are not occupied on a dresser, table, or a night stand, and otherwise rendering a system easily located on furniture within a room. Likewise, it would be an advance in the art to provide an aesthetically pleasing shape integrating all of the functions required for driving an atomizer of, perfume, essential oils, or other material desired to be distributed within an ambient environment.

It would be an advance in the art to provide an air pump for use in aroma therapy that is virtually silent. Reducing sound by several decibels is very difficult because of the fundamental nature of a vibrating motor driving a diaphragm pump. Accordingly, it would be a substantial advance in the art to create a mechanism for damping, isolating, or both, the mechanical vibration and acoustic vibration within air through a mechanical and fluid systems in order to provide a virtually silent pump. It would also be an advance in the art to provide a pump having long life, inexpensive components, easily replaceable parts, few moving parts, few wearing parts, economical maintenance, and simple assembly and operation.

BRIEF SUMMARY OF THE INVENTION

In view of the foregoing, in accordance with the invention as embodied and broadly described herein, a method and apparatus are disclosed in one embodiment of the present invention as including a system having a housing for a pump driven by an oscillating motor to draw liquids from a reservoir and distribute them through an eductor into the atmosphere.

The method may include adjusting an electronic controller to control at least one of a duration of operation and a duration of a delay between periods of operation of the pump. Operating the pump pressurizes ambient air into a flow that may be through other equipment such as an aquarium or an atomizer.

In some embodiments, the duty cycle may be controlled by controlling the ratio of the duration of operation to the duration of the delay plus the duration of operation. A method may provide a housing, a motor being disposed inside the housing and electrically powered to drive the pump.

In some embodiments, the pump comprises a pump body fitted with a valve plate captured in a pinch slot to support pressure between the pump body and valve plate. Seals positioned about openings passing the flow into and out of the pump may minimize pressure exposure of the structure of the pump. This is an improvement over conventional gaskets by being sized to fit within from about one to about three diameters, typically about two diameters, of the aperture corresponding to each seal.

The method may include the pump disposed within the housing, driven by a motor, and comprising a diaphragm compressing air and providing a flow thereof at a pressure greater than ambient pressure. The motor may have a coil and a magnet operably connected to reciprocate an armature magnet back and forth to move the diaphragm.

A control system operably connected to the coil may control electricity flowing to the coil, including voltage, current, off and on conditions, and so forth. The control system may include an actuator adjustable by a user to selectively and arbitrarily control the duration of delivery of electrical energy to the coil. A user may selectively and arbitrarily control a delay between adjacent periods of continuous delivery of electrical energy to the coil. A user may also arbitrarily control the duration of delivery of electrical energy to the coil and a delay between adjacent periods of continuous delivery of electrical energy to the coil.

A control system may provide infinitely variable adjustment between extremes (max and min values), to be set by a user arbitrarily selecting duration of operation, duration of deactivation between periods of operation of the motor, or both.

In some embodiments, a user may select a first time period corresponding to operation of the pump, arbitrarily selected between a first minimum time and a first maximum time, and selecting by a user a second time period corresponding to a delay in operation of the pump. The delay may be arbitrarily selected between a second minimum time and a second maximum time.

Typically, an apparatus may be constructed to contain a housing, a pump disposed within the housing (typically of a type having a diaphragm compressing air drawn from the ambient), and a magnetic electric motor driving the pump. The motor may be an oscillating type, having a coil and a first magnet (electromagnet) connected to reciprocate an electric field. The electromagnet drives a permanent magnet back and forth to oscillate the diaphragm. The pump may have two diaphragms in symmetric arrangement to reduce vibration.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
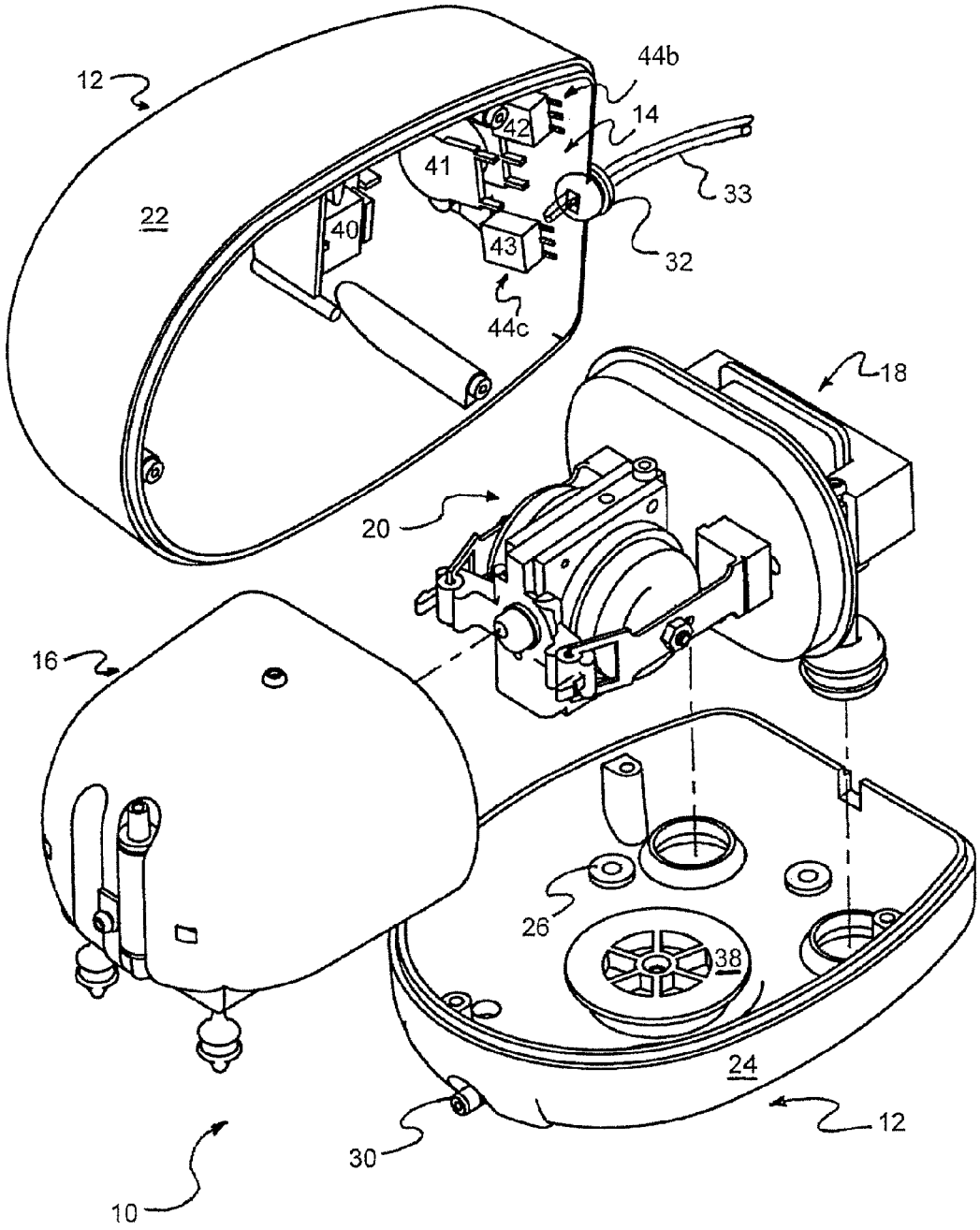
FIG. 1 is an exploded view of one embodiment of a quite pump apparatus in accordance with the invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, a system 10 or apparatus 10 may provide a supply of air virtually silently to drive various types of life support or breathable air. For example, a system 10 in accordance with the invention may supply air to an aroma therapy atomizer, aquarium, or the like. In general, an apparatus 10 may include an outer housing 12. The outer housing 12 may be divided into two portions in order to be able to receive other components therewithin.

In the illustrated embodiment, the outer housing contains electronics 14 or control systems 14 to control the volume, duration, and delay times between delivery of a supply of pressurized air. In the illustrated embodiment, an inner housing assembly 16 or inner housing 16 further provides isolation to separate a motor 18 or the larger and fixed components thereof from a pump 20 within the inner housing 16.

Mechanical isolation of the inner housing 16 from the outer housing 12 is provided by use of elastomeric components, damping, and decoupling of supports and by supports between the inner housing 16 or the outer housing 12. Selective positioning of required connections minimizes mechanical advantage and connection between various components.

Moreover, the inner housing 16 is substantially sealed as to any gaps that might pass acoustic vibrations. The exception to the sealing is the path of air actually being inducted and pressurized before being pumped out for use. Even that stream or flow of air is selectively isolated from certain components, passed through tortuous and narrow passages, to filter acoustics while exposed to other components, according to particular needs.

Figure 2:
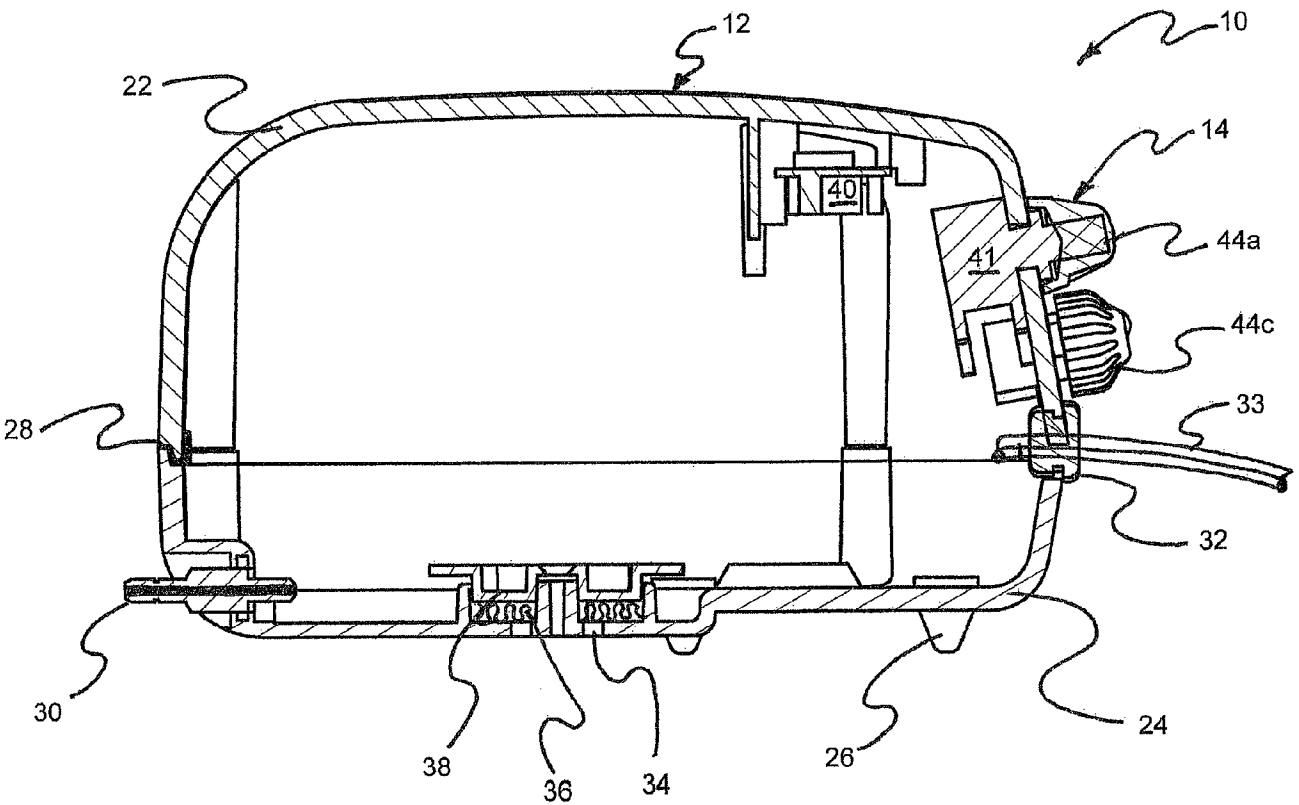
FIG. 2 is a cross-sectional, side, elevation view of one embodiment of an apparatus with certain items rendered schematically to show their arrangement.

Referring to FIG. 2, an upper shell 22 of the outer housing 12 is positioned opposite a lower shell 24 of the housing 12. In the illustrated embodiment, feet 26 are formed of an elastomer selected for its softness and thus damping of vibration. In this way, the outer housing 12, may be isolated further from its environment, such as a supporting surface, table, dresser, or the like.

The damping ability of the feet 26 in an axial direction (e.g., vertically, for example) may be substantial according to the selection of the elastomer from which the feet 26 are formed. Meanwhile, both the softness of the elastomer and the length or extent of each of the feet 26 also tends to provide radial isolation against any transmission of mechanical vibration therebetween.

In the illustrated embodiment, a seal 28 may be formed as a gasket, 'O' ring, or the like. Typically, the gasket 28 may be selected from various elastomers and shaped to provide a substantially hermetic seal between the upper shell 22 and lower shell 24 of the housing 12. An outlet 30 provides a controlled penetration between the outer housing 12 and the environment. Nevertheless, the outlet 30 in one currently contemplated embodiment is isolated from the other components contained within the outer housing 12 by a long, flexible tube that wraps inside the housing 12 in order to avoid supporting any mechanical connection of force or movement between the outlet 30 fixed to the housing 12, and any of the contained components therewithin.

Likewise, another penetration is made to support a fitting 32 supporting entrance of an electrical power cord. The length and flexibility of the cord 33, and its contained components, along with the selection of the softness of the elastomer from which the fitting 32 is fabricated provide for a tight, interference fit between the outer housing 12 and the fitting 32. For example, fasteners securing the upper shell 22 to the lower shell 24 capture the fitting 32 therebetween and can distort it elastomericaly in order to confirm a tight, hermetic seal therebetween.

The inlet 34 may be engineered as the only aperture 34 through which air may enter into the outer housing 12. All other penetrations are typically sealed against passage of air and transmission of sound therethrough. Meanwhile, openings such as the inlet 34 are provided highly circuitous paths of small dimension (e.g., from about one hundredth to about one quarter inch hydraulic diameter) in order to attenuate, absorb, and otherwise disrupt and redirect any acoustic waves that might escape from the apparatus 10 therethrough.

In the illustrated embodiment, the inlet 34 feeds air into a filter 36 or filter medium 36. Thereafter, air is released through a passage from the area of the filter 36 into the interior of the outer housing 12. The keeper 38 securing the filter medium 36 or filter 36 in position may be vented in various locations to provide passage of air from the inlet 34 into the interior of the housing 12.

As a practical matter, the difficulty of isolating vibration from mechanical reactions as well as acoustic (sound) waves from the moving components of the apparatus 10 is complicated by the fact that any use of energy, particularly motors, will generate heat. That heat must be dissipated. When it is dissipated, it must be transferred away into some medium such as the ambient air or it may destroy the electrical and electronic components generating that heat.

Accordingly, the need to transfer heat away from electrically active componentry stands in opposition to enclosing and isolating those same components in order to reduce or eliminate acoustic and mechanical vibrational interactions that may cause undesirable noise, chatter, or the like between the apparatus 10 and its environment, including its supporting surface. Thus, the inlet 34 provides cooling air for the motor 18 and the electronics 14 inside the outer housing 12.

Continuing to refer to FIGS. 1-2, a control assembly 40 or printed circuit board 40 equipped with the proper circuitry and controls may provide three principle control abilities. A flow control 41 typically controls the power to the motor 18. By control of power, the net throughput of air, measured by mass flow rate or volumetric flow rate may be controlled.

Meanwhile, a control 42 or controller 42 controls the duration of operation of the motor 18 driving the pump 20. For example, the duration control 42 may provide an infinitely variable selection of time from zero to any other number selected. In certain presently contemplated embodiments, a minimum time may be provided for the duration control, such as a minimum of 1 minute. Otherwise, the control 42 might have no dead space and might oscillate between an on and off condition indefinitely if improperly adjusted.

Likewise, as a practical matter for typical applications, a duration of from about 10 to about 60 minutes is typically a maximum time an individual may choose to have the pump 20 and motor 18 operating at one session. Similarly, delays of the same amounts may be selected. In one presently contemplated embodiment, times may set at from between 1 second and 60 minutes. Typically, it has been found suitable to permit or to select controls 42, 43 that may be set at any location on a continuously variable and infinitely variable scale between about 1 minute and 20 minutes.

The controller 43 or delay control 43 provides a user the ability to set arbitrarily and selectively the specific amount of time delay between adjacent durations of operation. For example, the duty cycle of a motor 18 and pump 20 may be controlled by the ratio of total duration of operation divided by the total time of delay plus that duration of operation. Thus, a duty cycle may be described as a fraction of the total elapsed time that the motor 18 and pump 20 are in actual operation. Various knobs 44*a*, 44*b*, 44*c* may control or provide actuation by a user for the flow control 41, duration control 42, and delay control 43, respectively. Here, knob 44*b* is identical to, and removed by the cross sectional cut from in front of, knob 44*c* in FIG. 2.

Figure 3:
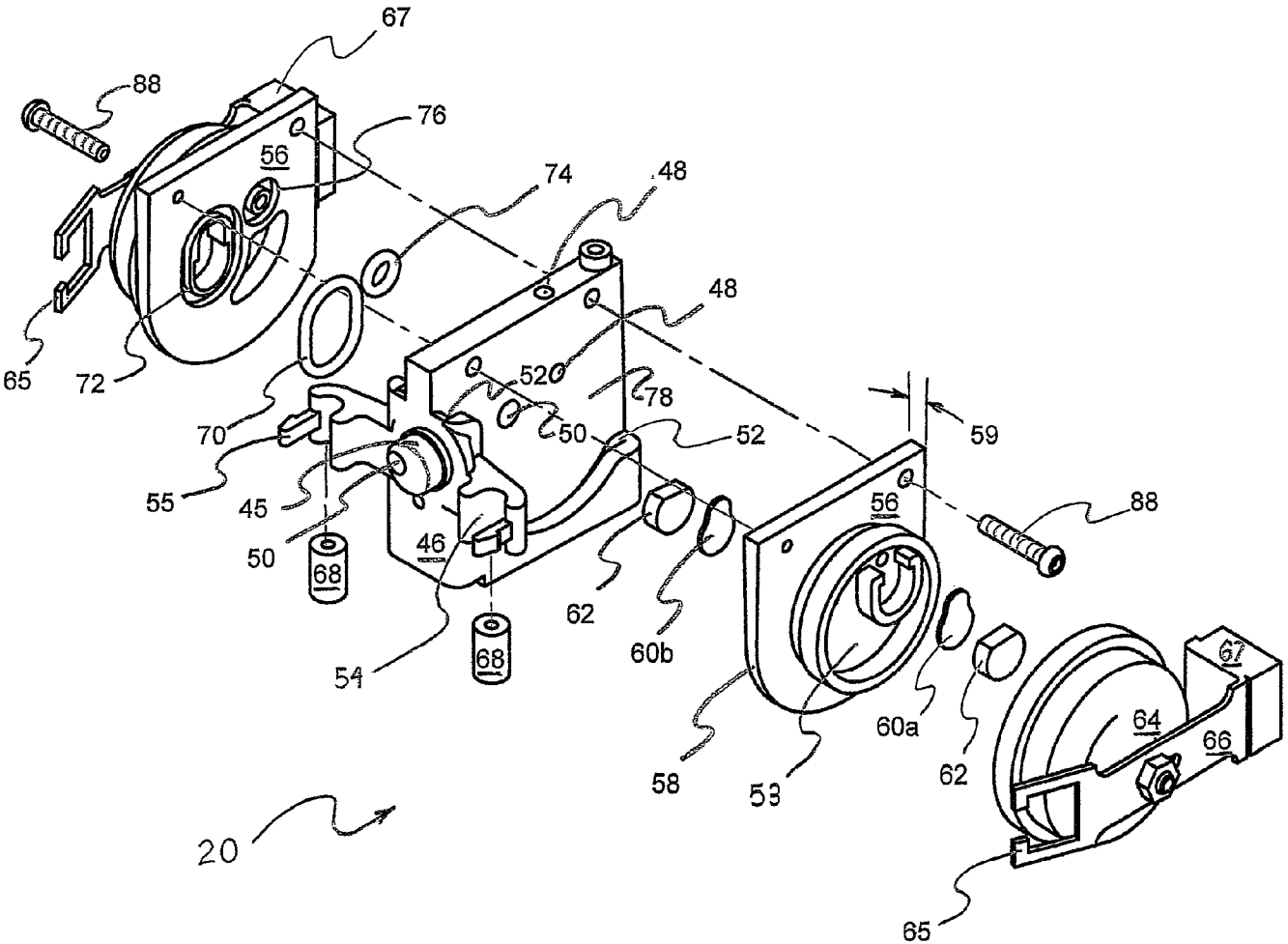
FIG. 3 is an exploded view of a pump for use in an apparatus and method in accordance with the invention as disclosed in FIGS. 1-2.

Referring to FIG. 3, while continuing to refer generally to FIGS. 1-2 the apparatus 10 may enclose within the inner housing 16 a pump 20. The pump 20 may provide air discharged through an outlet 45.

Referring to FIG. 3, the pump 20 may include a pump body 46 or body 46 central thereto. The body 46 may have formed therein a passage 48, here illustrated as it emerges from two faces of the body 46. The passage 48 provides an inlet for air coming from within the housing 12 into the pump 20. Likewise, a passage 50 originates from a face of the body 46, and eventually exits through the outlet 45 of the pump 20.

In the illustrated embodiment, a slot 52 or pinch slot 52 receives a valve body 56 therein, thus providing support along a large portion of the periphery of the valve body 56. Thus, the passages 48, 50 are operably connected to compression chambers 53 in the respective valve bodies 56. A retainer 55 may secure the pump body 46 to the inner housing 16 through apertures 90. The tapered face 58 of each valve body 56 illustrates that each is formed with an angle 59. Thus, the pinch slot 52 may more easily capture but then tightly secure the valve body 56 once it is fully inserted into the pinch slot 52.

Covering, and associated with the apertures in the pump body 56 corresponding to the passages 48, 50 in the pump body, are reeds 60 or flappers 60 secured by keepers 62. (The generic reference may be used herein to represent all of the specific examples, such as a generic 60 for specifics 60*a*, 60*b*, here illustrated, and 102 for 102*a*, 102*b* hereinbelow) The reeds 60 act as one-way valves, each permitting flow in one direction and resisting flow in the opposite direction. Accordingly, each of the compression chambers 53 may draw air in through the passage 48, then seal off the passage 48 with the reed 60. Accordingly, the passage 50 may be sealed off against back flow, but opened to be accessible by the reed 60*b* opposite the reed 60*a*. Actually, the reeds 60*a*, 60*b* are not exactly opposite one another but rather, each is on an opposite side of the valve body 56, acts in an opposite direction, and services an aperture for one of the passages 48, 50.

Typically, a diaphragm 64 may be formed in a single piece to secure about the chamber 53. Thus, a diaphragm 64 may form a sealing and a closure for the chamber 53. Each diaphragm 64, of which there may be a single diaphragm 64, or multiple diaphragms 64, may be secured to the pump 20 by fasteners to a swing arm 66. The swing arm 66 itself may include a yoke 65 secured to a hinge 68. Meanwhile, opposite the yoke 65 a magnet 67 secured to the swing arm 66 operates as an armature 67 in conjunction with the drive mechanism.

The yoke 65, capturing a hinge 68, such as a resilient tubing may provide a comparatively wear-free, damping, long-lived attachment mechanism. The hinges 68 recessed into the retainer 54 provide a pivot access for each of the swing arms 66 about the yokes 65 thereof.

Various seals 70 may be provided to both limit and secure passage of air through the pump 20. For example, a seal 70 may be formed as an 'O' ring fitted into a slot 72 or groove 72. Accordingly, the seal 70 provides securement of the flow of air from the passage 50 into the valve body 56. Likewise a seal 74 may be configured to fit in a groove 76 or slot 76 sealing the passage of air between the passage 48 and the valve body 56. Thus, the seals 70, 74 fit between the valve bodies at the grooves 72, 76, and against the faces 78 of the pump body to effect their seal.

The diaphragms 64 operate by the oscillation of the armatures 67 driving the swing arms 66 to pivot about their yokes 65 and hinges 68. Accordingly, the armatures 67 pivot in an almost linear fashion, driven by electromagnetic forces.

The reeds 60*a*, 60*b* provide substantially instantaneous valving in accordance with the pressure within and without the chamber 53. Thus, air is drawn into the chamber 53 by the diaphragm 64 as it moves away from the valve body 56. Similarly, air is pushed back from the diaphragm through the valve body 53 and into the passage 50 by the diaphragm 64 under the control of the reeds 60*b*.

Figure 4:
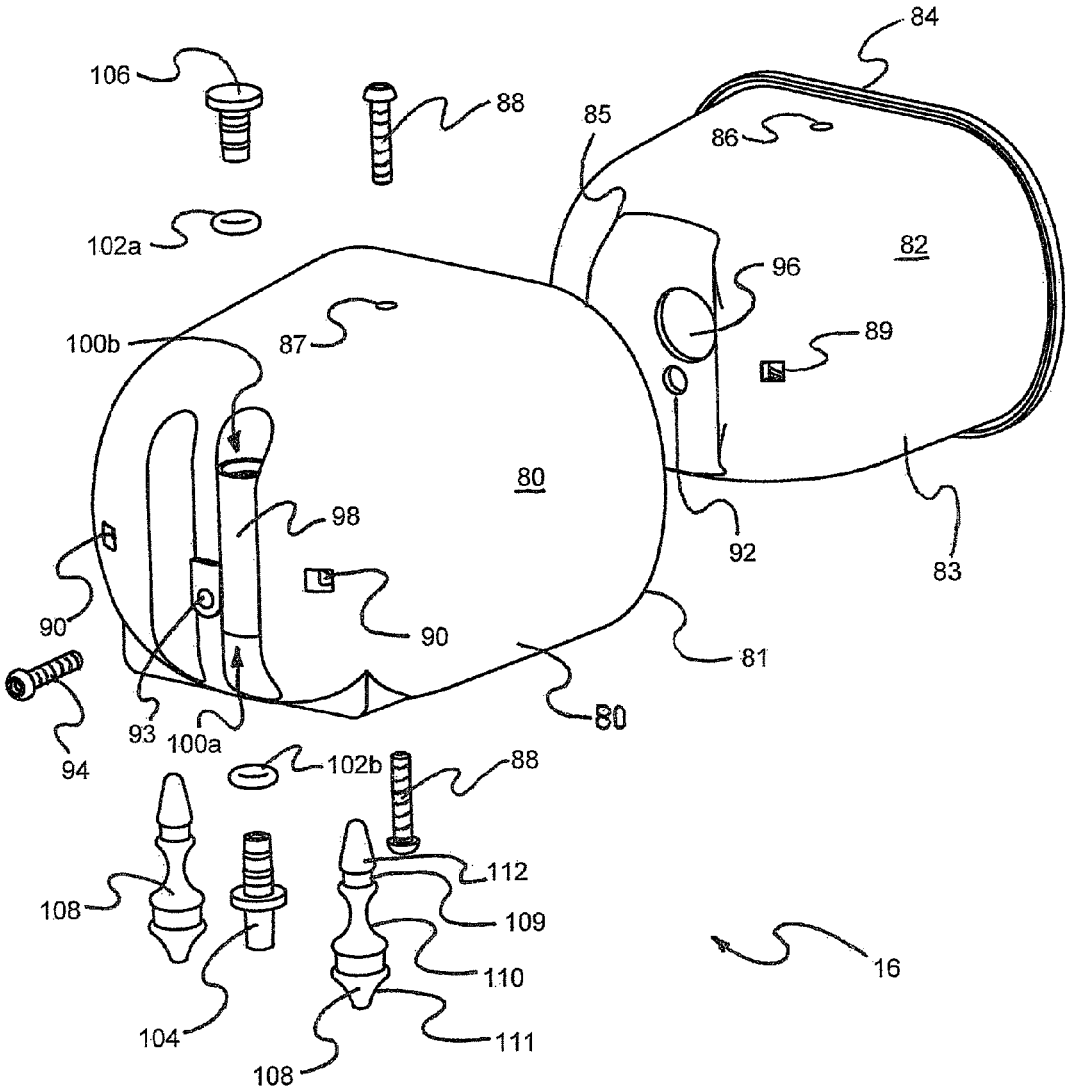
FIG. 4 is an exploded view of the inner housing of the apparatus of FIGS. 1-2 with its liner and other vibration isolation mechanisms.

Referring to FIG. 4, while referring generally to FIGS. 1-3, the inner housing 16 may include a comparatively harder structural component such as a shell 80. The shell 80 may be provided with an edge 81 to receive a closure. Prior to closure of the shell 80, a liner 82 may be inserted therewithin. In the illustrated embodiment, the liner 82 is formed of a comparatively soft elastomer selected for its ability to dampen sound and vibration rather than transmitting it therethrough or therealong.

For example, the wall 83 of the liner 82 may be comparatively thin, thus in combination with the soft elastomeric properties of the material thereof may substantially reduce or eliminate any vibration or transmission of vibration along the surface thereof. Meanwhile, by selecting hardness (e.g., softness) for the elastomer from which the liner 82 is molded or otherwise formed, the liner may substantially dampen any vibration or acoustic vibration passing through the wall thereof.

In one embodiment, the liner 82 may be spaced a distance away from the shell 80 in order to provide an air gap therebetween. In the illustrated embodiment, the lip 84 of the liner 82 fits inside the shell 80. Meanwhile, no continuous source of substantial contact is made between the wall 82 and the shell 80, except near the relief 85. The relief 85 is formed in the liner 82 in order to accommodate certain manufacturing components.

For assembling the apparatus 10, a method may include insertion of the liner 82 into the shell 80 of the inner housing 16. The shell 80 may be provided with an edge to capture the lip 84. In one embodiment, a recess or groove inside a shoulder within the interior of the shell 80 captures the lip 84 and secures it, urging it against the outer most contact with the interior surface of the shell 80.

Meanwhile, inserting the liner 82 a sufficient distance into the shell 80 permits alignment of an aperture 86 in the liner 82 with an aperture 87 in the shell 80. Each of the liner 82 and the shell 80 may include both upper and lower apertures 86, 87, respectively. Upon alignment of the apertures 86, 87, a fastener 88 may pas through both apertures 86, 87 to secure the pump 20 therewithin.

As a practical matter, the fasteners 88 may provide a mechanical coupling between the pump 20 and the shell 80. Thus, a principal purpose of the shell 80 in the illustrated embodiment is to provide acoustic isolation, of the pump from its environment, notwithstanding vibrational or mechanical vibration isolation is not occur as effectively between the pump and the shell 80. Rather, the inner housing 16 is mechanically isolated by other mechanisms to be described hereinbelow.

An additional aperture 89 may receive fasteners from the pump. The aperture 89 may be aligned with the aperture 90 to pass a clip 55 from the pump 20 therethrough to register and temporarily secure the pump 20 or align the pump 20 in registration with the shell 80. Thereafter, an aperture 92 may be aligned with an aperture 93 in order to receive a fastener 94 securing the shell 80 to the pump 20. Thus, the pump is held rigidly to the shell 80 with the soft elastomer of the liner 82 between a pump 20 and the shell 80 to damp vibrations. Meanwhile, the pump 20 is suspended by three fasteners 88, 94 providing a secure, 3-point connection in order to minimize misalignment and chatter between the pump 20 and the shell 80.

The aperture 96 is sized to form an interference fit with the outlet 45 of the pump 20. The outlet 45 has a diameter larger than that of the aperture 96. Accordingly, the elastomeric material of the liner 82 stretches to fit around the outlet 45, thus making an effective acoustic and hermetic seal between the pump 20 and the remaining interior of the outer housing 12. Because each of the fasteners 88, 94 may be tightened to compress the liner 82 between the fastener 88, 94 and the pump 20, the apertures 86, 92 may provide clearance fits, which may then be closed by compression according to Poisson's principle controlling distortion of materials.

The outlet 45 feeds air from the pump 20 directly into a chamber 98 or plenum 98. The chamber 98 may be provided with one or more ports 100. In the illustrated embodiment, the port 100*a* opens downward, while the port 100*b* opens upward. Meanwhile, seals 102*a*, 102*b* seal each port 100*a*, 100*b*, respectively. In the illustrated embodiment, an adaptor or fixture 104 sometimes referred to as a barbed fitting may fit into the port 100*a* to receive a connecting line for conducting air from the pump 20 to a delivery point.

Meanwhile, in the illustrated embodiment, a plug 106 closes off the port 100*b*. The ports 100*a*, 100*b* may be configured as desired with a fitting 104 or a plug 106. Meanwhile, the seals 102*a*, 102*b* provide air-tight sealing by a mechanism such as gaskets, 'O'-rings, or the like.

Legs 108 provide substantially complete radial isolation of mechanical vibrations between the shell 80 and the outer housing 12. According to the softness (alternative of hardness) of the elastomeric material from which the legs 108 are formed, an additional degree of axial (e.g., vertical) isolation is also provided between the shell 80 and the outer housing 12.

In the illustrated embodiment, the legs 108 each contain a collar 109 or collar portion 109 that may be fitted with an interference fit in a corresponding aperture (not shown) in the shell 80. The leg 108 may be stretched to insert the collar 109 into the aperture, into which the resilience of the leg 108 will shorten the length thereof and expand the diameter of the collar 109 to provide the interference fit.

Meanwhile, a neck 110 or neck portion 110 provides an extremely small diameter that is substantially radially unstable. Thus, the softness selected for the elastomeric material of the leg 108 may be further enhanced by the small diameter of the neck 110. Accordingly, a foot 111 resting on the lower shell 24 of the outer housing 12 can support substantially no lateral (radial) forces to be transmitted between the shell 80 and the outer housing 12. Meanwhile, the softness of the elastomer of the leg 108 provides additional isolation in an axial direction to both dampen and isolate vibrations generated by the pump and transmitted to the shell 80 from transmitting to the outer housing 12.

Above the collar 109 a keeper 112 provides securement of the leg 108 within an aperture (not shown) in the shell 80. The diameter of the keeper 112 may be reduced by stretching the length of the leg 111, thus providing for insertion of the collar 109 through an aperture. Thereafter, upon release of the extension force the length of the leg 108 will return to an equilibrium position leaving the keeper 112 and the remainder of the leg 108 to capture the shell 80 on either end of the collar 109.

In general, the liner 82 and the legs 108 may be formed of polymers having elastomeric properties suitable for isolation and damping of mechanical vibration. Likewise, any acoustic vibration transmitted to the shell 80 may be damped thereby to an extent designed by selection of the materials. Meanwhile, the use of an extended length of conduit or tubing formed of soft polymer or elastomer and connected to the fitting 104 will also provide substantial vibration isolation from any mechanical vibration or force that might otherwise be transmitted between the shell 80 and the outer housing 12.

Figure 5:
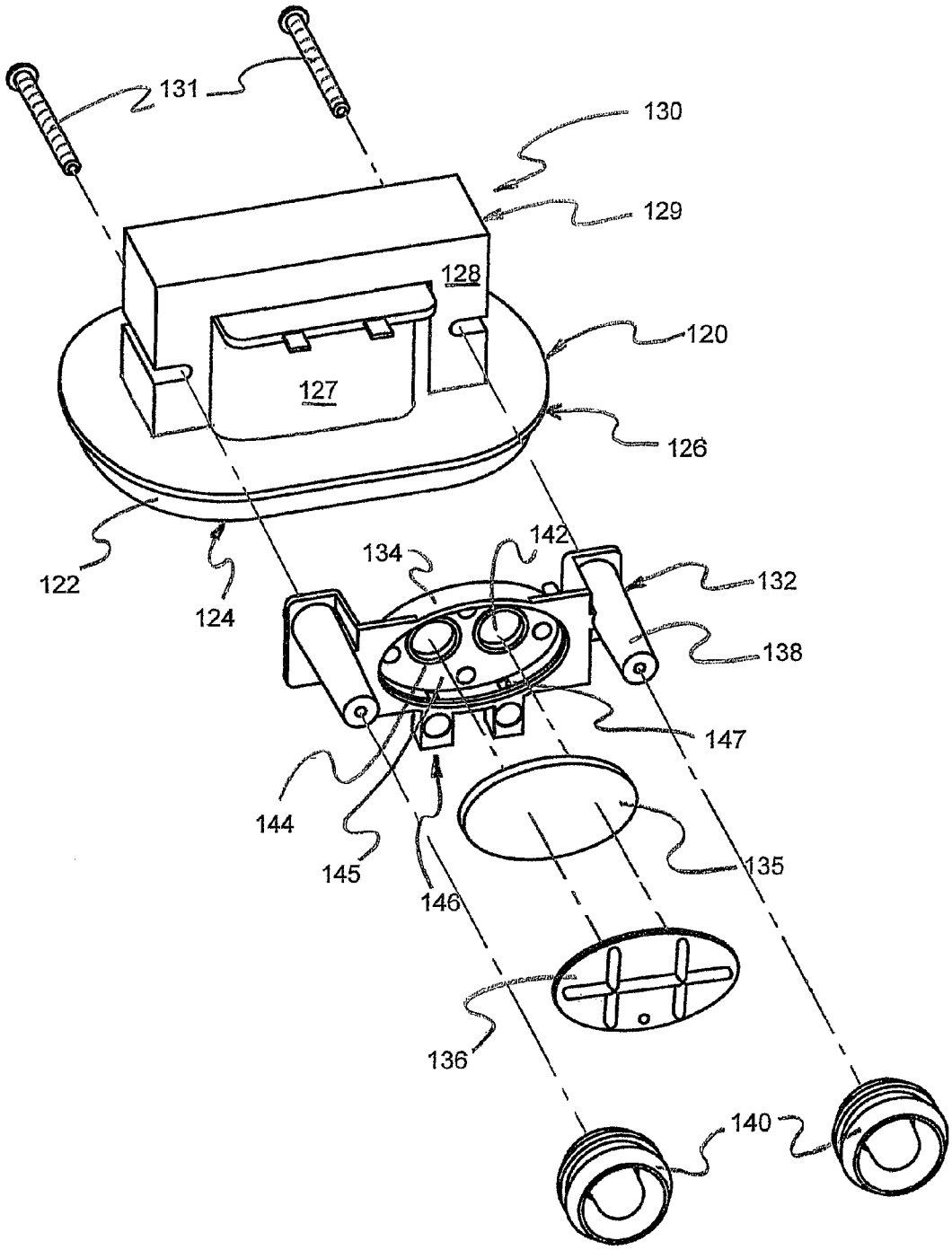
FIG. 5 is an exploded view of the end cap for the inner housing having the motor magnet potted therein and illustrating an exploded view of the mounting and filter hardware as well as isolation feet for this portion of the inner housing and motor support.
Figure 6:
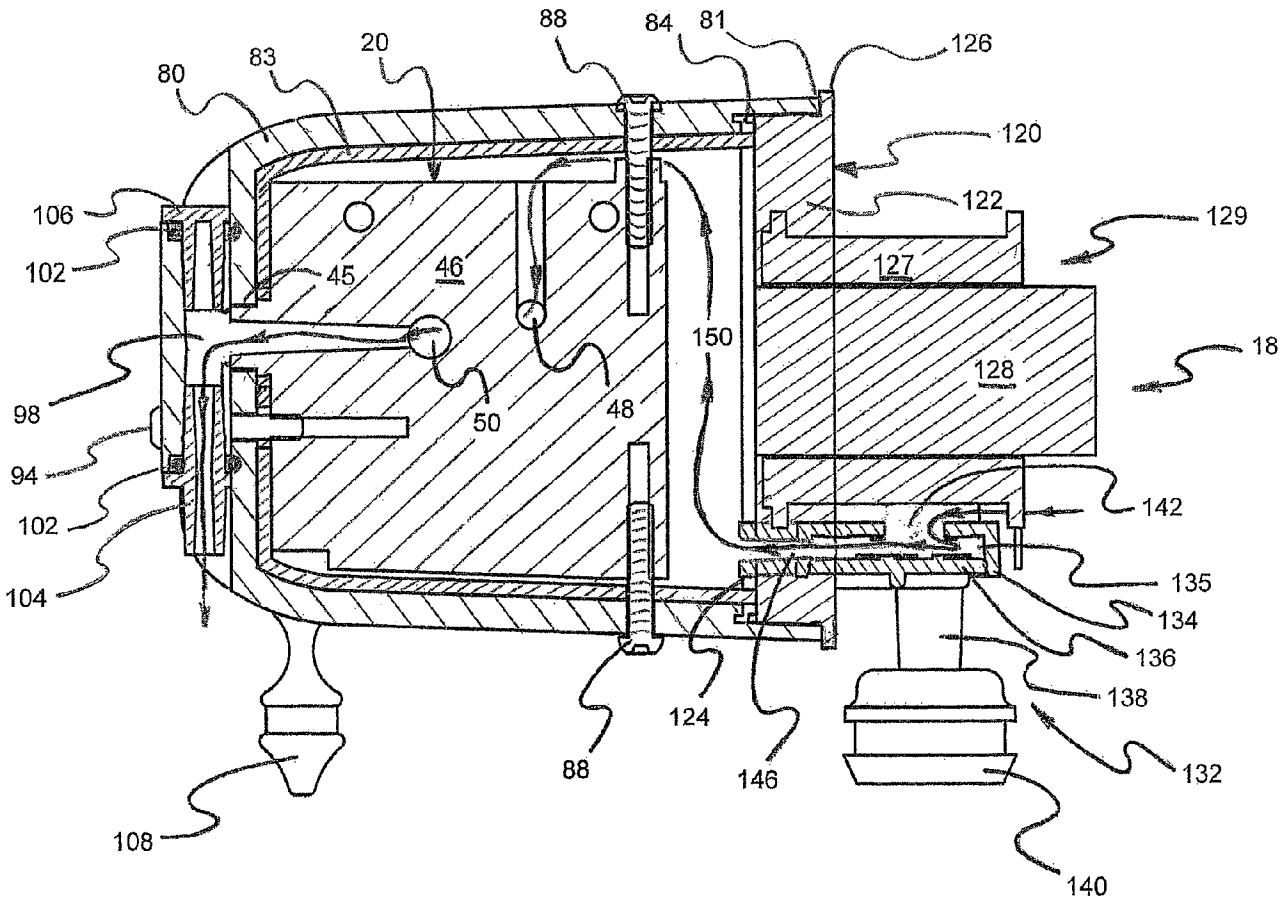
FIG. 6 is a cross-sectional, side, elevation view of the apparatus of FIG. 1 assembled and illustrating the flow of air therethrough.

Referring to FIGS. 5-6, while continuing to refer generally to FIGS. 1-4, an end plate 120 forms the completion of the enclosure of the inner housing 16. In one embodiment, the end plate 120 may include a coupler 122 or coupler portion 122 inserted inside the open end of the shell 80. The coupler 122 terminates at a face 124 sealed and impervious to any transmission of mass, particularly air. The coupler 122 thus presses the face 124 against the lip 84 of the liner 82. Accordingly, the coupler 122 serves as a keeper 122 holding the lip 84 into its slot within the shell 80.

The lip 84, being made of the same material as the remainder of the liner 82, thus provides the mechanical damping of vibrations between the coupler and the shell 80. Perhaps more importantly, the lip 84 thus provides a gasket sealing the interior of the liner 82 against the face 124. Every opening in the liner 82 may be sealed by compression, an interference fit, or the like. Accordingly, with the exception of the path of pumped air into and out of the pump is substantially sealed against any movement of gas or sound waves (e.g., air) therethrough.

A rim 126 on the end plate 120 may be homogeneously molded with the end plate. In one embodiment, the entire end plate 120 including the coupler 122, rim 126, and the coil 127 and coil 128 assembled may be potted together. The end plate 120 may be cast, or may be formed as a partial casting to be potted later with the magnet assembly 129 (e.g., coil 127 and coil 128) potted therein. Thus, the end plate 120 may be homogeneously molded as a single piece containing both the coupler 122 and rim 126 and potting the magnet 129 of the motor 130 therewithin.

In the illustrated embodiment, the face 124 may be spaced away from all parts of the magnet 129. Accordingly, both the coil 127 and the core 128 may be spaced away from the face 124 in order to provide a complete, integral seal thereby. Meanwhile, the coupler 122 may be provided with a detent of some type such as a groove, boss, rise, clip, barb, or the like to engage a corresponding portion of the shell 80 in order to secure the coupler 122 inside the shell 80.

A portion of the motor 130, the magnets 67 are illustrated in FIG. 3. The magnets 67 operate near but without contacting the face 124. Thus, the magnets 67 may interact with the magnetic core 128 of the motor 130 without actually contacting any part thereof mechanically.

Fasteners 131 inserted through relief locations within the core 128 may secure the motor 30 to the mount 132. The mount 132 in the illustrated embodiment serves multiple functions. For example, the mount 132 provides a housing 134 to contain a filter 135 or filter medium 135. That is, sometimes it is proper to speak of a filter as both the housing 134 and the contained filtering media 135. A keeper 136 or lid 136 may snap into the housing 134 to secure the filter 135 therewithin.

In addition to the filter housing 134, a mount 132 provides legs 138 to support the motor 130 within the inner housing 16. In order to maintain the mechanical isolation of a inner housing 16 with respect to the outer housing 12, the legs 135 may be provided with isolating feet 140.

In the illustrated embodiment, the feet 140 are formed in a convoluted shape such that an inner portion thereof receives a leg 138, while the outer portion thereof is offset both radially and axially to extend beyond the inner portion. Thus, radial motion of the leg 138 is isolated by the convoluted shape of the foot 140. Meanwhile, axial movement due to vibration of the leg 138 is actually taken up and absorbed, by the convolution in the foot 140. In certain embodiments, the selection of any elastomeric material to form feet 140 may provide sufficient thickness and softness to absorb a substantial portion of any mechanical vibration presented by the leg 138.

It may be seen from the foregoing that the inner housing 16 remains mechanically isolated from the outer housing 12. Restraints formed in the outer housing 12 to contain the feet 140 against radial and axial motion will not constrain substantially the leg 138 captured therein. Thus, as explained, the leg 138 may translate axially and radially without requiring movement of the portion of the outermost perimeter of the foot 140.

It may be seen that the feet 140, along with the leg 108 positioned at the opposite end of the inner housing 16 provide isolation and damping in three dimensions and nearly perfect isolation in at least two.

The filter housing 134 contains inlet apertures 142 or apertures 142 receiving air from inside the outer housing 12. Since the filter housing 134 is located outside the shell 80 and its enclosing end plate 120 or cap 120 air must pass near or around the coil 127 and core 128 of the magnet 129 to gain access to the apertures 142. Thereafter, the air must pass down through the apertures 142 and around the rim surrounding each. Thereafter, the air must pass through the filter medium 135, up over rims (see FIG. 6) on the hidden side of the lid 136.

Various slots in the rims of the lid 136 may provide preferential release of air to enforce these more circuitous paths towards the nearest wall, and thus through a greater extent of the filter media 135, instead of the most direct route from the aperture 142 to the outlet 146. The outlet 146 is connected by a passageway 147 in the filter housing 134. Air may then pass from the outlet 146 into the cavity 150 of the shell 80. The cavity 150 is contained within both the liner 82 and the shell 80.

As can be seen, the path of air provides a draw bringing air from within the surrounding environment into the outer housing 12 through an inlet 34. From within the interior of the outer housing 12, air is drawn from a location near the motor 130, and particularly the coil 127 and core 128 thereof to enter the inlet 142 of the filter housing 134. After passing through the filter media 135 and through the outlet 146, the air is free to circulate within the cavity 150 of the inner housing 16. From a location at or near the top of the cavity 150, the passage 48 draws in the air into the pump as described hereinabove. Meanwhile, the pump body receives air from the chambers 53 into the passage 50 for discharge through the outlet 45. From the outlet 45, air passes into the chamber 98, which passes the pressurized air out through the fixture 104 into a connecting line to be discharged to the environment. The connecting line (not shown) is formed of a sufficiently soft elastomer of a sufficient length to isolate the inner housing 16 from the outlet 30 and thus the outer housing 12.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method comprising:

providing a pump, a motor driving the pump, an inner housing assembly comprising an inner housing and outer housing, the inner housing having an end plate, sealing the inner housing relative to the outer housing, and containing the pump and an armature of the motor therewithin;

separating a coil and core of the motor away from the armature of the motor by embedding in the material of the end plate the coil and core as part of the inner housing assembly;

containing completely the inner housing within the outer housing;

supporting the outer housing on a substantially planar surface defining radial directions contained therein and an axial direction perpendicular thereto;

supporting the inner housing on elastomeric feet each having a thickness effective to isolate radial transmission of motion between the armature and the outer housing;

operating the armature to move substantially exclusively in an arc substantially parallel to the planar surface; and damping axial motion of the inner housing assembly against transmission of axial motion between the inner housing and the outer housing.

2. The method of claim 1, wherein the outer housing is sealed against air passing thereinto except air passing into the pump.

3. The method of claim 1, wherein the inner housing is sealed against air passing thereinto except air passing into the pump.

4. The method of claim 1, further comprising assembling the inner housing, wherein assembling comprises:

providing the end plate, having the core and coil embedded therein, and an inner shell; and inserting the end plate as a cap into an opening of the inner shell to close the inner shell therewith.

5. The method of claim 1 further comprising:

drawing air from the ambient into the outer housing exclusively through an outer aperture sized to have a maximum characteristic dimension corresponding to a wavelength outside and below the range of human hearing.

6. The method of claim 1, further comprising:

drawing air from the outer housing into the inner housing exclusively through an inner aperture sized to have a maximum characteristic dimension corresponding to a wavelength outside and below the range of human hearing.

7. The method of claim 1, further comprising:

drawing air into the outer housing exclusively through an outer aperture; and filtering proximate the outer aperture substantially all air passing therethrough.

8. The method of claim 7, further comprising:

drawing air from the outer housing into the inner housing exclusively through an inner aperture; and filtering proximate the inner aperture substantially all air passing therethrough.

9. The method of claim 1, further comprising:

drawing air from the outer housing into the inner housing exclusively through an inner aperture;

positioning the inner aperture proximate the coil; and cooling the coil by passing thereacross air passing into the inner aperture.

10. The method of claim 1, further comprising acoustically isolating sound generated within the inner housing against passing through a fluid path to an ambient outside the outer housing.

11. The method of claim 10, wherein acoustically isolating comprises:

limiting all openings in the inner and outer housings to passages carrying air drawn and pumped by the pump; and limiting the maximum characteristic dimension of the fluid path, at all points along the fluid path of the air, to a size corresponding to a wavelength outside and below the range of human hearing.

12. The method of claim 1, further comprising damping acoustic waves by shaping the inner housing and outer housing to minimize corners capable of reflecting sound waves.

13. The method of claim 1, wherein supporting the inner housing assembly further comprises selecting a size, shape, and material of the elastomeric feet to reduce sound emanating from the outer housing by from about 1 to about 30 decibels below sound emanating from the combined pump and armature.

14. The method of claim 1, wherein supporting the inner housing assembly further comprises selecting a size, shape, and material for the elastomeric feet reducing sound by from about 10 to about 20 decibels between the outer housing and the combination of the pump and armature.

15. The method of claim 1, further comprising positioning a liner inside the inner housing and spaced away from the inner housing except at locations of mechanical fastening between the pump and the inner housing, the liner being formed of an elastomeric material selected to have a hardness effective to damp acoustic waves between the pump and the inner housing and between the armature and the inner housing.

16. A method comprising:

providing a pump, a motor driving the pump, an inner housing assembly comprising an inner housing and outer housing, the inner housing having an end plate, sealing the inner housing relative to the outer housing, and containing the pump and an armature of the motor therewithin;

separating a coil and core of the motor away from the armature of the motor by embedding the coil and core into the end plate of the inner housing as part of the inner housing assembly;

containing completely the inner housing within the outer housing;

supporting the outer housing on a substantially planar surface defining radial directions contained therein and an axial direction perpendicular thereto;

operating the armature to move substantially exclusively in an arc substantially parallel to the planar surface;

supporting the inner housing on elastomeric feet each having a thickness effective to isolate radial transmission of motion between the armature and the outer housing, and to dampen axial motion of the inner housing against transmission of axial motion between the inner housing and the outer housing;

sealing the inner and outer housings against air passing thereinto except air passing into the pump;

providing the inner housing assembly by providing the end plate as a cap, having the core and coil embedded therein and inserting the cap into an opening of the inner housing to close the inner housing therewith.

17. The method of claim 16, further comprising:

drawing air from the ambient into the outer housing exclusively through an outer aperture sized to have a maximum characteristic dimension corresponding to a wavelength outside and below the range of human hearing;

drawing air from the outer housing into the inner housing exclusively through an inner aperture sized to have a characteristic dimension corresponding to a wavelength outside the range of human hearing;

positioning the inner aperture proximate the coil, cooling the coil by passing thereacross air passing into the inner aperture;

acoustically isolating sound generated within the inner housing against passing through a fluid path to the ambient outside the outer housing by limiting all openings in the inner and outer housings to passages carrying air drawn and pumped by the pump;

limiting the maximum characteristic dimension of the fluid path, along the fluid path of the air, to a size corresponding to a wavelength outside and below the range of human hearing.

18. The method of claim 16, wherein:

positioning a liner inside the inner housing comprises positioning the liner inside and spaced away from the inner housing except at locations of mechanical fastening between the outer housing and the inner housing, the liner being formed of an elastomeric material selected to have a hardness effective to damp acoustic waves between the pump and the inner housing and between the armatures and the inner housing;

sealing the inner and outer housings further comprises limiting the maximum characteristic dimension of the flow path of air to a value corresponding to the wavelength of sound outside and below the range of human hearing; and supporting the inner housing assembly further comprises selecting a size, shape, and material of the elastomeric feet to reduce sound emanating from the outer housing by more than 10 decibels.

19. An apparatus comprising:

an outer housing enclosing an outer cavity;

an inner housing positioned within the outer cavity and comprising an inner shell and a cap enclosing an inner cavity;

a motor comprising an electromagnet having a core and coil disposed outside the inner cavity and an armature comprising a permanent magnet disposed within the inner cavity;

the inner housing, wherein the cap comprises a base portion molded to embed therein the core and coil and separating the core and coil from the armature;

the inner housing, wherein the cap further comprises a rim therearound, the base portion being molded therewithin and the rim securing the cap to the inner shell;

a pump disposed within the inner shell and operably connected to the armature driving the pump to compress air;

the inner housing, further comprising a liner spaced away from the inner shell except at locations of mechanical fastening of the inner housing to at least one of the motor and pump, the liner being formed of an elastomeric polymer selected and positioned to absorb mechanical and acoustic vibration between the inner shell and the combination of the pump and armature, isolating the pump and armature from the core and coil;

the inner housing, wherein the inner shell comprises a distal end spaced from the cap, and a proximal end secured to the cap, the inner housing further comprising a fastener securing the pump to the distal end to register the armature with respect to the core embedded into the cap;

supports comprising elastomeric members defining an axial and radial direction, and oriented to extend axially as the exclusive path of support between the inner housing and the outer housing and shaped to have a minimum thickness effective to isolate the inner and outer housings against transmission of radial loads therebetween.

* * * * *